US009907389B2

(12) United States Patent
Conlin

(10) Patent No.: US 9,907,389 B2
(45) Date of Patent: Mar. 6, 2018

(54) SINGLE PIECE HAMMOCK STRAP WITH INTEGRAL WOVEN EYELETS

(71) Applicant: Kammok Holdings, LLC., Austin, TX (US)

(72) Inventor: Tyler Conlin, Layton, UT (US)

(73) Assignee: Kammok Holdings, LLC, Austin, TX (US)

( * ) Notice: Subject to any disclaimer, the term of this patent is extended or adjusted under 35 U.S.C. 154(b) by 0 days.

(21) Appl. No.: 14/935,983

(22) Filed: Nov. 9, 2015

(65) Prior Publication Data

US 2017/0127808 A1 May 11, 2017

(51) Int. Cl.

| | |
|---|---|
| ***A47F 5/00*** | (2006.01) |
| ***A45F 3/24*** | (2006.01) |
| ***D03D 3/08*** | (2006.01) |
| ***D05B 93/00*** | (2006.01) |

(52) U.S. Cl.
CPC ..... *A45F 3/24* (2013.01); *D03D 3/08* (2013.01); *D05B 93/00* (2013.01)

(58) Field of Classification Search
CPC ..... A45F 3/24; A45F 2005/006; A45F 3/22
See application file for complete search history.

(56) References Cited

U.S. PATENT DOCUMENTS 4,319,428 A * 3/1982 Fox ..... A01G 17/04 24/115 H
4,697,314 A * 10/1987 Ohman ..... A44B 11/06 24/132 R
4,871,068 A * 10/1989 Dreyfus ..... B65D 5/2033 206/200
5,143,266 A * 9/1992 Heckerman ..... A44B 11/006 224/150
5,174,481 A * 12/1992 LeDune ..... A45F 5/00 224/250
5,363,810 A * 11/1994 Kraus ..... A01K 27/003 119/795
5,660,309 A * 8/1997 Belanger ..... A45B 11/02 224/250
D388,558 S * 12/1997 Miller ..... D30/153
D454,235 S * 3/2002 Kaplan ..... D30/153
D454,670 S * 3/2002 Weller ..... 119/795
6,353,946 B1 * 3/2002 Steiner ..... A45B 3/00 5/120

(Continued)

FOREIGN PATENT DOCUMENTS

DE 202015002130 U1 * 4/2015 ..... A45F 5/00
GB 2304570 A * 3/1997 ..... A45B 11/02
WO WO 2013166340 A1 * 11/2013 ..... A45F 3/12

OTHER PUBLICATIONS

Merriam-Webster Online Dictionary, Merriam-Webster Online, https://web.archive.org/web/20051226165243/https://www.merriam-webster.com/dictionary/end, Dec. 26, 2005.*

*Primary Examiner* — Amy Sterling
(74) *Attorney, Agent, or Firm* — Travis R. Banta; Atlas Intellectual Property Law

(57) ABSTRACT

This disclosure generally relates to a hammock strap. The hammock strap includes an elongated length of strap material that is separated into a first strap and a second strap. The first strap and the second strap are woven together at one or more separation points to form eyelets between the first strap and the second strap.

10 Claims, 4 Drawing Sheets

(56) References Cited

U.S. PATENT DOCUMENTS 6,357,551 B1 * 3/2002 Bogardus, III ..... E06C 1/56 182/190
6,606,768 B2 * 8/2003 Henry ..... A45F 5/00 24/298
7,357,433 B2 * 4/2008 Hess ..... B66C 1/18 294/74
D573,381 S * 7/2008 Pinholster, Jr. ..... D6/387
D654,231 S * 2/2012 Clayton ..... D30/153
D666,896 S * 9/2012 Pinholster, Jr. ..... D8/356
8,628,488 B2 * 1/2014 Serola ..... A61B 17/1325 128/846
D712,555 S * 9/2014 Berg ..... D24/190
9,003,579 B1 * 4/2015 Pinholster, Jr. ..... A45F 3/22 5/120
9,237,796 B2 * 1/2016 Finch ..... A45F 5/00
9,320,343 B1 * 4/2016 Pinholster, Jr. ..... A45F 3/24
D760,503 S * 7/2016 Arguelles ..... D6/315
9,750,329 B1 * 9/2017 Pinholster, Jr. ..... A45F 3/24
2002/0104202 A1 * 8/2002 Henry ..... A45F 5/00 24/306
2006/0226038 A1 * 10/2006 Lampley ..... A45F 3/00 206/315.9
2008/0282515 A1 * 11/2008 Crevin ..... A45F 5/00 24/298
2009/0025185 A1 * 1/2009 Banes ..... B65D 63/18 24/3.1
2009/0095039 A1 * 4/2009 Nagamine ..... A45C 13/30 70/457
2014/0259551 A1 * 9/2014 Egbert ..... A45F 3/14 24/302
2014/0304952 A1 * 10/2014 Mathews ..... A45F 5/00 24/302
2015/0237995 A1 * 8/2015 Finch ..... A45F 5/00 294/25
2015/0320185 A1 * 11/2015 Ganz ..... A45F 3/14 224/255
2015/0355530 A1 * 12/2015 James ..... G03B 17/561 224/267
2016/0081446 A1 * 3/2016 Maddox ..... A45C 11/00 224/257
2016/0095420 A1 * 4/2016 Moreau ..... A45F 5/021 248/341
2016/0095421 A1 * 4/2016 Moreau ..... A45F 5/00 248/341
2016/0213136 A1 * 7/2016 Roehrig ..... A45F 5/00

* cited by examiner

SINGLE PIECE HAMMOCK STRAP WITH INTEGRAL WOVEN EYELETS

BACKGROUND

1. Technical Field

This disclosure relates generally to a single piece hammock strap with integral woven eyelets. More specifically, the hammock strap disclosed herein is useful in outdoor applications, such as, for example, supporting a hammock.

2. Description of the Related Art

Many outdoor activities require that participants camp overnight in order to fully enjoy a chosen work or recreational activity. However, camping, in many cases, is substantially less comfortable than sleeping in a bed. This lack of comfort can lead to restless sleeping, poor rest, and general fatigue, lessening the overall enjoyment of the chosen work or recreational activity for which the participants camped overnight in the first place.

Tents, sleeping pads, tarps, makeshift shelters, recreational vehicles, and other sleeping implements increase the ability of participants in outdoor activities to enjoy spending the night in the outdoors. However, these exemplary sleeping implements are not practical for use in many situations. For example, a hiker on a backpacking trip must carry tools with which to construct a shelter or the shelter itself (i.e., a tent) to the place in which the hiker intends to camp. Carrying either tools or a tent, however, presents other difficulties.

For example, when campers do not have access to a vehicle while camping, and sometimes even when campers do have access to a vehicle, a camper can be limited in the equipment that can be brought because of both excessive weight and excessive bulk. While many would consider a bed to be more comfortable to sleep in than a tent, most campers cannot carry a bed to a camping spot because the bed is too heavy to practically carry. Similarly, some tents may also be too heavy to carry when a camper considers the other items the camper must bring to increase comfort while camping. Excessive bulk is better described in terms of volume. For example, a camper may use a pack that has a finite volume and that can only hold camping comfort items of a specific size. Some camping comfort items, while not necessarily heavy, require a substantial amount of space within a pack. Thus, a camper must carefully balance the gear that can or should be brought camping with the amount of weight that can be carried and the available space in which the gear can be carried.

Hammocks have conventionally been reliable to increase camper comfort during an overnight outdoor activity while also being relatively light and relatively compact, compared to a tent, for example. The main drawback of a hammock is finding a suitable area in which to hang the hammock. In order for a camper to use the hammock under conventional conditions, a camper must find two fixed structures, such as trees, that are appropriately spaced and large enough to support the weight of the camper in the hammock. Conventionally, hammock campers use rope to tie each end of a hammock to a tree at an appropriate height. However, many times, the rope used to tie each end of a hammock slips or slides down the tree, resulting in the camper dropping to the ground. Under conventional conditions, campers would find trees with branches at an appropriate height that would prevent a tie rope from sliding down a tree. Frequently, however, other branches on the tree would have to be cut to allow the camper to stretch a tie rope around a tree. This resulted in substantial damage to trees in popular camping areas.

In response to this arboreal damage caused by campers with hammocks, many states passed laws preventing campers from damaging live trees by hanging hammocks. Accordingly, attempts were made to provide hammock tie down attachments that do not cause damage to trees. One such attempt is described in U.S. Pat. No. 9,003,579, which describes a hammock support strap. Essentially, this hammock support strap provides a plurality of hook points that are folded over on each other and sewn into the strap using stitching. When one looped end of the strap is inserted in another looped end of the strap, the strap cinches down on a tree without damaging the tree. The camper may attach a hammock to one of the hook points along the length of the strap. These folded over portions of the strap provide adequate strength to support a camper's weight within the hammock.

At the same time, however, conventional hammock straps, such as the one described above, require substantial stitching by skilled seamster, which increases production costs. More problematic, however, is that the folding portion of the hooks to provide adequate strength to support a camper's weight in the hammock also substantially increases the overall bulk of conventional straps. In other words, the folded over portion of the hooks along the strap, by its very nature creates more undesirable bulk because the folds increase the overall space required to contain the strap during transport to and from a camping site.

It is therefore one object of this disclosure to provide a hammock strap useful in, but not limited to, attaching a hammock to a fixed structure, such as a tree. Another object of this disclosure is to provide a hammock strap that reduces weight and bulk. Finally, an object of this disclosure is to provide a method of making a hammock strap.

SUMMARY

Disclosed herein is a hammock strap. The hammock strap includes an elongated length of flexible strap material that is separated into a first strap and a second strap. The first strap and the second strap are woven together at one or more separation points to form one or more eyelets between the first strap and the second strap.

Further disclosed herein is a method of making a hammock strap. The method includes weaving one or more fibers together to form an elongated length of flexible strap material. The elongated length of flexible strap material may be separated into a first strap and a second strap at a first separation point. Further, one or more fibers in the first strap are woven into one or more fibers in the second strap at a second separation point, thereby forming an eyelet in the hammock strap.

BRIEF DESCRIPTION OF THE DRAWINGS

The accompanying drawings illustrate an embodiment of a hammock strap.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the hammock strap disclosed herein. While the techniques and embodiments will primarily be described in context with the accompanying drawings, those skilled in the art will further appreciate that the techniques and embodiments may also be practiced in other similar apparatuses.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
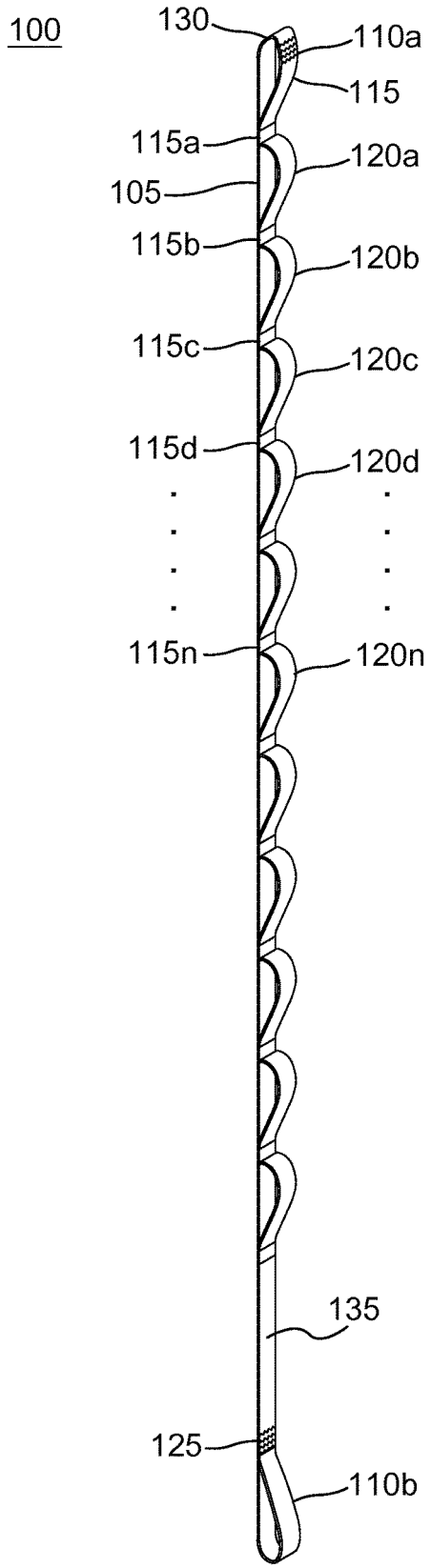
FIG. 1 illustrates an exemplary implementation of a hammock strap.

FIG. 1 illustrates an exemplary implementation of a hammock strap 100. Hammock strap 100 is typically constructed using a flat flexible strap material. Exemplary materials for hammock strap 100 include "webbing," a material typically made of synthetic fibers including nylon, polypropylene, polyester, Dyneema, and Kevlar. Webbing is typically constructed with a breaking strength in excess of 10,000 pounds of force. Webbing is further an ideal choice for hammock strap 100 because it is resistant to abrasion, has relatively little stretch under a load, does not damage trees, and is not particularly sensitive to ultra-violet sunlight. Hammock strap 100 is typically constructed by weaving synthetic fibers together to produce the flexible strap material in the configuration of hammock strap 100.

Hammock strap 100 may be woven from these synthetic fibers such that hammock strap 100 begins with an elongated section 135 of flexible strap material between loop 125 and an eyelet 120*n*. Hammock strap 100 terminates on an eyelet end 110*a* and fixed end 110*b* hammock strap 100. In general, terminating hammock strap 100 at eyelet end 110*a* may be a result of either sewing strap portion 105 to an eyelet strap portion 115 or, alternatively, weaving fibers from strap portion 105 into fibers from eyelet strap portion 115 to create loop 130. Terminating hammock strap 100 at fixed end 110*b* may also be a result of either sewing an elongated section 135 of flexible strap material back on itself or, alternatively, weaving fibers from an elongated section 135 of flexible strap material back into itself at another point on elongated section 135 of flexible strap material to create loop 125*b*. The termination of hammock strap 100 will be further discussed below.

Hammock strap 100 may be constructed as a single piece. For example, while synthetic fibers are being woven together to create hammock strap 100, the synthetic fibers may be separated such that a strap portion 105 and an eyelet strap portion 115 are woven as individual straps from the elongated section 135 of flexible strap material. More simply, the thickness (or alternatively the width) of hammock strap 100 may be divided in half such that strap portion 105 and eyelet strap portion 115 become separate lengths of flexible strap material which are re-connected at various points along hammock strap 100. After a desired length of flexible strap material is created for both strap portion 105 and eyelet strap portion 115, strap portion 105 and eyelet strap portion 115 may be rejoined together at a separation point, such as separation point 115*a*. Separation points 115*a*, 115*b*, 115*c*, 115*d* to 115*n* refer to points along hammock strap 100 where the separated strap portion 105 and the separated eyelet strap portion 115 may be woven together and re-separated successively to form eyelets 120*a*, 120*b*, 120*c*, 120*d* to 120*n*. Accordingly, hammock strap 100 is woven such that hammock strap 100 may be divided into a strap portion 105 and an eyelet strap portion 115 that may be selectively rejoined into hammock strap 100 at two or more separation points (e.g., 115*a* and 115*b*) along the length of hammock strap 100, forming one or more eyelets (e.g., 120*a*)

As shown, n number of separation points 115*a*-115*n* may join and separate, by selectively interweaving, strap portion 105 to/from eyelet strap portion 115, although preferable implementations will include between 2 and 15 separation points 115*a*-115*n*. Separation points 115*a*-115*n* each form a corresponding eyelet 120*a*, 120*b*, 120*c*, 120*d*, to 120*n* between strap portion 105 and eyelet strap portion 115. Since eyelets 120*a*-120*n* are formed by separation points 115*a*-115*n*, and n number of separation points 115*a*-115*n* may be implemented along strap portion 105 using eyelet strap portion 115, n number of eyelets may also be implemented between strap portion 105 and eyelet strap portion 115. As before, however, preferable implementations of hammock strap 100 will include between 2 and 15 eyelets 120*a*-120*n* between strap portion 105 and eyelet strap portion 115. In contrast to eyelets 120*a*-120*n*, eyelet end 110*a* and fixed end 110*b* of hammock strap 100 are terminated using loop 125 and loop 130. Loops, herein, are distinguished from eyelets in that loops are created in eyelet end 110*a* and fixed end 110*b* by sewing using a series of sewing stitches referred to as a bartack or by interweaving the elongated section 135 of flexible strap material back on itself or to eyelet strap portion 115, as described above. A bartack stitch, as used herein, means any number of individual stitches that connect one section of a strap to another section of a strap across substantially the entire width of the strap.

Loop 125 on fixed end 110*b* is shown in FIG. 1 as being terminated by looping the elongated section 135 of flexible strap material back on itself and stitching the elongated section 135 of flexible strap material to itself using four bartack stitches. Alternatively, loop 125 may be created by weaving the elongated section 135 of flexible strap material back into itself. Loop 130 on eyelet end 110*a*, however, is created by stitching an end of eyelet strap portion 115 to strap portion 105 using four bartack stitches. Alternatively, loop 130 may be created by weaving strap portion 105 into eyelet strap portion 115. Of course, while four bartack stitches are shown in FIG. 1, any number of bartack stitches may be used to join loop 125 and loop 130.

In practice, strap portion 105 and eyelet strap portion 115 are separated from each other by altering the weaving technique used to create hammock strap 100. Strap portion 105 and eyelet strap portion 115 begin as a single elongated section 135 of webbing, for example, that forms hammock strap 100. The length of eyelet strap portion 115 may vary depending on the number of eyelets 120*a*-120*n* that are created by interweaving strap portion 105 and strap portion 115. In one embodiment, eyelet strap portion 115 is separated from strap portion 105, forming a first one of separation points 115*a*-115*n*. In this embodiment, a second one of separation points 115*a*-115*n* is again created by weaving eyelet strap portion 115 into strap portion 105 and then re-separating eyelet strap portion 115 from strap portion 105. Along strap portion 105, a length of flexible strap material between the first one of separation points 115*a*-115*n* and the second one of separation points 115*a*-115*n* is less than a length of flexible strap material between the first one of separation points 115*a*-155*n* and the second one of separation points 115*a*-155*n* along eyelet strap portion 115. Thus, because there is a longer portion of webbing between two separation points along eyelet strap portion 115 than there is between the two separation points along strap 105, an eyelet 120*a*-120*n* is formed between the two separation points on hammock strap 100. Further separation points 115*a*-115*n* are similarly formed until the desired number of eyelets 120*a*-120*n* are created along hammock strap 100. In one embodiment, the sizes of each eyelet 120*a*-120*n* are consistent along the length of hammock strap 100. As mentioned above, when the desired number of eyelets 120*a*-120*n* is achieved by weaving an appropriate number of separation points 115*a*-115*n*, strap portion 105 and eyelet strap portion 115 are sewn together using bartack stitching or woven together to form loop 130 at eyelet end 110*a*. Similarly, loop 125 is formed by sewing an end of strap portion 105 back into itself or weaving an end of strap portion 105 back into itself to form fixed end 110*b*. Accordingly, hammock strap 100 is formed.

The weaving/separating of strap portion 105 and eyelet strap portion 115 at separation points 115*a*-115*n* provides a number of advantages. First, weaving fibers of eyelet strap portion 115 into the fibers of strap portion 105 is typically performed by a machine, which reduces labor and production costs when compared to conventional straps. Second, weaving strap portion 105 and eyelet strap portion 115 at separation points 115*a*-115*n* provides a connection that is stronger than conventional straps that are folded over and manually sewn together. Third, weaving strap portion 105 and eyelet strap portion 115 at separation points 115*a*-115*n* provides a mechanical connection point between the fibers of strap portion 105 and the fibers of eyelet strap portion 115, which substantially maintains the original breaking strength of the material, for example webbing, that is used to construct hammock strap 100. This mechanical connection between the fibers of strap portion 105 and the fibers of eyelet strap portion 115 is superior to other methods of connection such as heat welding, sonic bonds, adhesive based connections, metal fasteners, or other methods of connecting straps that are known in the art. These other methods of connection are more likely to fail under pressure or a load because these other methods of connection have a much lower breaking strength than, for example, the webbing itself. For example, the breaking strength of heat welding, sonic bonds, or adhesive based connections, relies on the strength of the weld, the bond, the adhesive, or other connections to maintain the connection. Frequently, the breaking strength of heat welding, sonic bonds, adhesive based connections is drastically lower than the breaking strength of the webbing itself introducing failure points at the connections. Thus, because the strength of a woven connection maintains substantially the same breaking strength as the original strap, failure points are eliminated. Thus, a woven connection is superior to these other methods of connection.

While conventional folded over and sewn connections are fairly strong, these connections add additional undesirable bulk to the strap. A woven strap eliminates the bulk created by folded over and sewn connections. For example, a folded and sewn connection in a strap increases the thickness of the strap at the fold to over three times the thickness of the initial strap, when the stitching is included in the overall thickness of the strap at the fold. The thickness of the woven connection at separation points 115*a*-115*n* is the same thickness of hammock strap 100 from which strap portion 105 and eyelet strap portion 115 are separated.

As used herein, the term weaving means interconnecting one or more fibers to either form a flexible strap material or to interconnect one or more fibers of one section of a strap with one or more fibers of another section of a strap. Fibers, which form one strap portion, are integrally wrapped around or between fibers from another strap portion in a manner that fastens the two sections of strap together in a permanent fashion. Weaving should not be confused with sewing in which one or more threads that do not make up any portion of a strap to be connected to another is successively inserted through two or more layers of strap material by a needle to form sewn stitches (i.e., sewn by a machine using one or more sewing threads in a chain stitch, a lockstitch, an overlock stitch, or coverstitch.)

In practice, hammock strap 100 may be used to support a load at any height by connecting the load to any one of eyelets 120*a*-120*n*. For example, hammock strap 100 may be attached to a fixed structure, such as a tree, by wrapping hammock strap 100 around a tree. Eyelet end 110*a* may be inserted through loop 125 in fixed end 110*b* and pulled such that loop 125 surrounds hammock strap 100. Pulling on eyelet end 110*a* therefore tightens hammock strap 100 around the exemplary tree. Once hammock strap 100 is tightened to the exemplary tree, each of the individual eyelets 120*a*-120*n* or loop 130 become points at which a load may be connected to hammock strap 100. In other words, each of the individual eyelets 120*a*-120*n* or loop 130 allow a load to be attached at a particular height along hammock strap 100. For example, if a user wished to attach a load as low to the ground as possible once hammock strap 100 is tightened around an exemplary tree, the user may attach the load to loop 130. If, alternatively, a user wished to attach a load as high above the ground as possible once hammock strap 100 is affixed to an exemplary tree, the user may attach the load to eyelet 120*n*. Similarly, the user may adjust the height of a load supported by hammock strap 100 as appropriate for any application by attaching the load to any of eyelets 120*a*-120*n* or loop 130. In another embodiment, hammock strap 100 may include an elongated section 135 between loop 125 and eyelet 120*n* that accommodates a large diameter tree. Thus, when hammock strap 100 is attached to a tree, elongated section 135 may allow each of eyelets 120*a*-120*n* to be accessible in that each one of eyelets 120*a*-120*n* passes through loop 125 before hammock strap is tightened to the tree.

While applications for use of hammock strap 100 abound, in one embodiment, two of hammock straps 100 may be used to provide anchor points for a hammock. Since a user may select any eyelet 120*a*-120*n* along the length of hammock strap 100 as an attachment point for a hammock, the user may have a much wider range in which acceptable fixed structures may be located to secure a hammock. Further, the user may choose to angle one end of the hammock to be higher than another by attaching, for example, a hammock to eyelet 120*a* on one of hammock strap 100 while attaching a second end of a hammock to loop 130 on a second hammock strap 100. Other exemplary uses for hammock strap 100 include securing a water vessel at a height suitable for cooking or bathing, securing food or other wildlife attractants in the air between trees, or securing a pack off the ground.

Figure 2:
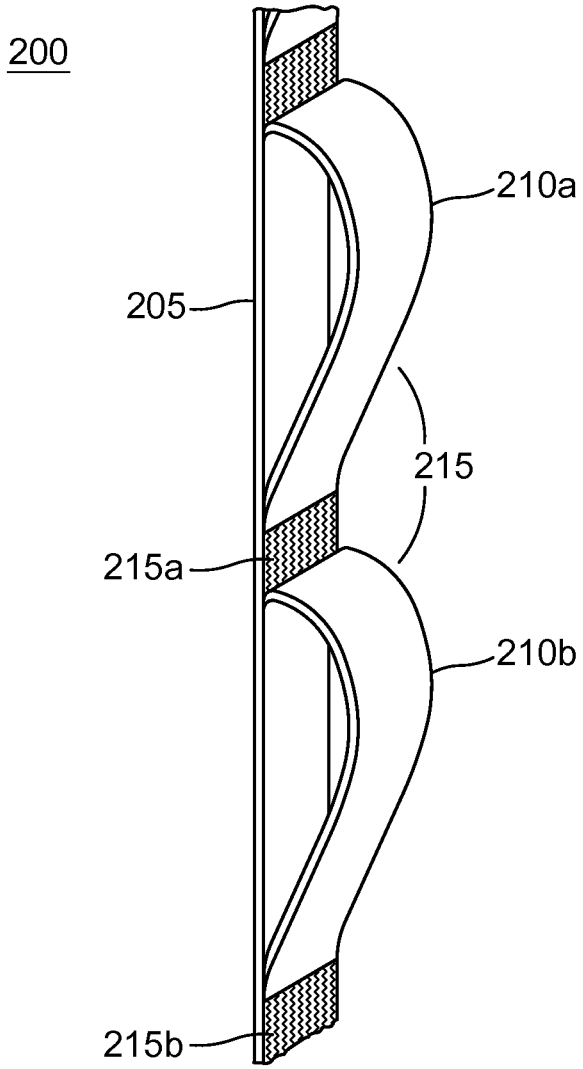
FIG. 2 illustrates a magnified view of two separation points along the hammock strap.

FIG. 2 illustrates a magnified view of hammock strap 200 including a strap portion 205, similar in description to strap portion 105 shown in FIG. 1; eyelets 210*a* and 210*b*, similar in description to eyelets 120*a* and 120*b* shown in FIG. 1; eyelet strap portion 215, similar in description to eyelet strap portion 115 shown in FIG. 1; and separation points 215*a* and 215*b*, similar in description to separation points 115*a* and 115*b* shown in FIG. 1. As discussed above with respect to FIG. 1, while only eyelets 210*a* and 210*b* are shown in FIG. 2, any number of eyelets may be implemented along strap portion 205. Further, as shown in FIG. 2, separation point 215*a* and separation point 215*b* may be implemented by a weaving technique that secures eyelet strap portion 215 to strap portion 205 at various points along hammock strap 200. Eyelet 210*b*, for example, is therefore created by separation point 215*a* being positioned along strap portion 205 in an anterior relation to eyelet 210*b* and by separation point 215*b* being positioned along strap portion 205 in a posterior relation to eyelet 210*b*, thereby forming eyelet 210*b*. Each eyelet along strap portion 205 is similarly created to form hammock strap 200.

Figure 3A:
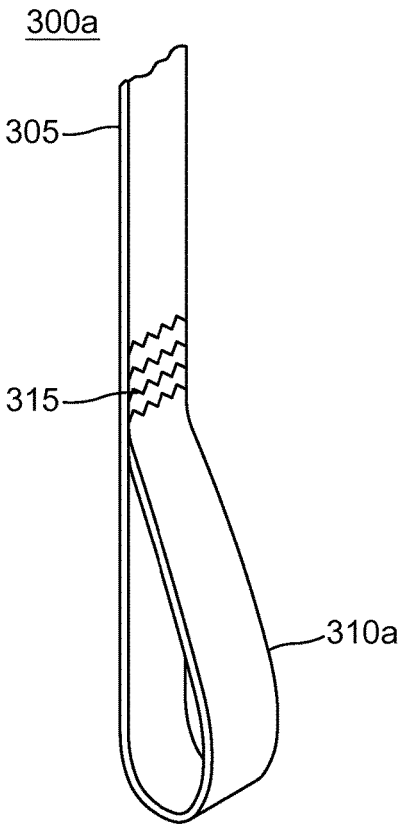
FIG. 3*a* illustrates a first end of the hammock strap.

FIG. 3*a* illustrates fixed end 310*a* of hammock strap 300*a*. Hammock strap 300*a* includes elongated section 305, similar in description to elongated section 135, shown in FIG. 1; fixed end 310*a*, similar in description to fixed end 110*b*, shown in FIG. 1; and loop 315, similar in description to loop 125, shown in FIG. 1. FIG. 3*a* illustrates the creation of loop 315 by sewing one end of elongated section 305 to itself to form loop 315 and fixed end 310*a*. While four bartack stitches are shown in FIG. 3*a*, this is merely representative of stitching that may be employed to secure the one end of elongated section 305 to itself to form loop 315 and fixed end 310*a*. Loop 315*a* may also be created by weaving an end of strap portion 305 back into itself. Fixed end 310*a* terminates hammock strap 300*a* on one end.

Figure 3B:
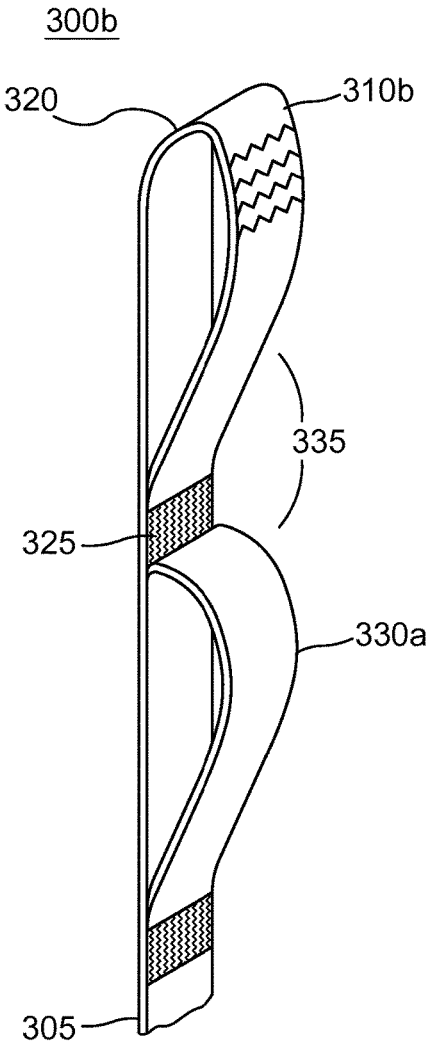
FIG. 3*b* illustrates a second end of the hammock strap.

FIG. 3*b* illustrates an eyelet end 310*b* of hammock strap 300*b*. Hammock strap 300*b* includes strap portion 305, similar in description to strap portion 105, shown in FIG. 1; eyelet end 310*b*, similar in description to eyelet end 110*a*, shown in FIG. 1; loop 320, similar in description to loop 130, shown in FIG. 1; connection point 325, similar in description to connection point 115*a*, shown in FIG. 1; eyelet 330*a*, similar in description to eyelet 120*a*, shown in FIG. 1; and eyelet strap portion 335, similar in description to eyelet strap portion 115, shown in FIG. 1. FIG. 3*b* illustrates the creation of loop 320 by sewing one end of strap portion 305 to an end of eyelet strap portion 335 to form eyelet end 310*b*. While four bartack stitches are shown in FIG. 3*b*, this is merely representative of stitching that may be employed to secure the one end of strap portion 305 to an end of eyelet strap portion 335. Alternatively, strap portion 305 may be woven into eyelet strap portion 335 to form loop 320 on eyelet end 310*b*. Eyelet end 310*b* terminates hammock strap 300*b* on an end opposite of fixed end 310*a*, shown in FIG. 3*a*.

Figure 4:
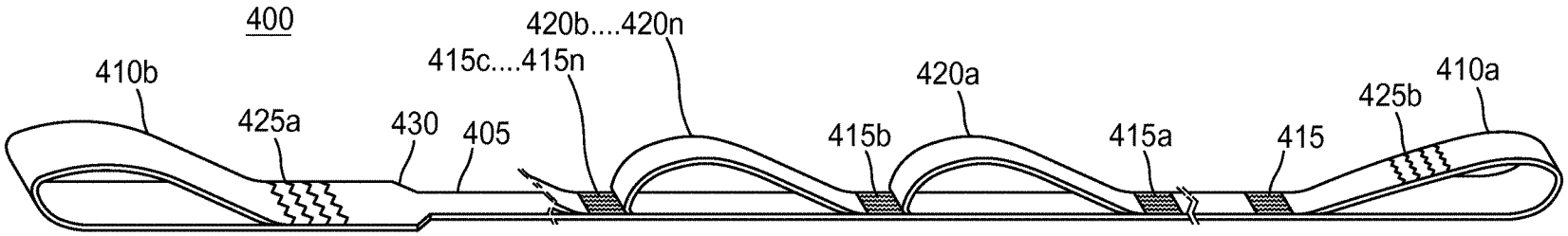
FIG. 4 illustrates the exemplary hammock strap in an enhanced bulk reducing embodiment.

FIG. 4 illustrates an embodiment of hammock strap 400 which eliminates additional bulk from hammock strap 400. As shown in FIG. 4, strap portion 405 is tapered from fixed end 410*b* to eyelet end 410*a*. In a similar fashion to that described above, strap portion 405 and eyelet strap portion 415 are separated from hammock strap 400 during the weaving of hammock strap 400, essentially separating a single piece of flexible strap material into two separate strap segments. Strap portion 405 is then interwoven/separated at separation points 415*a*, 415*b*, 415*c* to 415*n* with eyelet strap portion 415 to form eyelets 420*a*, 420*b*, 420*c* to 420*n*. Loop 425*a* is formed by sewing an elongated section of hammock strap 400 back into itself, illustrated, merely for representative purposes, using four bartack stitches. Alternatively, loop 425*a* may be created by weaving a portion of hammock strap 400 back into itself. Loop 425*b* is formed by sewing an end of strap portion 405*a* to an end of eyelet strap portion 415, illustrated, merely for representative purposes, using four bartack stitches. Alternatively, loop 425*b* may be created by weaving a portion of strap portion 405 into eyelet strap portion 415.

In order to further reduce the bulk and weight of hammock strap 400, hammock strap 400 may be tapered in an elongated section of hammock strap 400 between loop 425*a* and eyelet 420*n*, corresponding to elongated section 135 shown in FIG. 1. In one embodiment, the elongated section of hammock strap 400 includes taper 430 which tapers hammock strap 400 from a full width down to half of the full width. In other words, if hammock strap 400 is implemented using a one inch wide webbing strap, taper 430 tapers hammock strap 400 to one half of an inch between loop 425*a* and eyelet 420*n*. In one embodiment, strap portion 405 and eyelet strap portion 415 are formed using the tapered width of hammock strap 400. For example, if strap portion 405 tapers to one half of an inch, eyelet strap portion 415 is also formed by weaving a one half of an inch wide webbing strap. Eyelet strap portion 415 may therefore be woven, as described above, with strap portion 405 to form separation points 415*a*, 415*b*, 415*c* to 415*n* and eyelets 420*a*, 420*b*, 420*c* to 420*n*. Tapering the width of hammock strap 400 and using a less wide strap portion 405 and eyelet strap portion 415 reduces both the weight and bulk of hammock strap 400 since less material is used in construction of the strap than would be used if the strap was not tapered.

Figure 5:
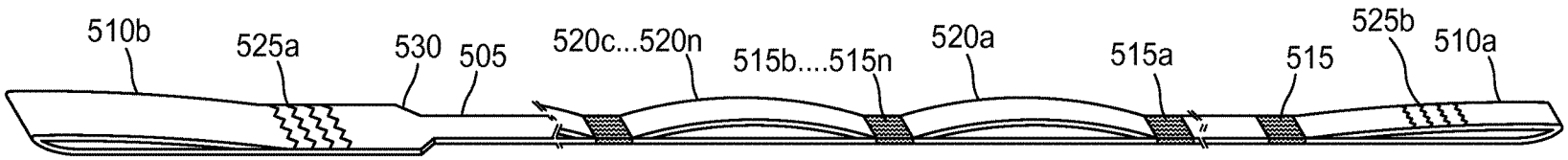
FIG. 5 illustrates the exemplary hammock strap in a second enhanced bulk reducing embodiment.

FIG. 5 illustrates another embodiment of hammock strap 500 which eliminates additional bulk from hammock strap 500. As shown in FIG. 5, hammock strap 500 is tapered from fixed end 510*b* to eyelet end 510*a*. In a similar fashion to that described above, strap portion 505 is interwoven at separation points 515*a*, 515*b*, 515*c* to 515*n* with eyelet strap portion 515 to form eyelets 520*a*, 520*b*, 520*c*, to 520*n*. Loop 525 is formed by sewing or weaving an elongated section of hammock strap 500 back into itself, illustrated merely for representative purposes, using four bartack stitches. Loop 525 is formed by sewing or weaving an end of strap portion 505 to or into an end of eyelet strap portion 515, illustrated merely for representative purposes using four bartack stitches.

In order to further reduce the bulk and weight of hammock strap 500, the elongated section of hammock strap 500 may be tapered between loop 525*a* and eyelet 520*n* by taper 530. Taper 530, as discussed above with respect to taper 430 in FIG. 4, provides the additional benefits of reduced overall bulk and weight of hammock strap 500. However, FIG. 5 illustrates another independent bulk reducing alternative that may be used whether hammock strap 500 is tapered or not.

As shown in FIG. 5, eyelets 520*a*, 520*b*, 520*c* to 520*n* are formed such that the length of eyelet strap portion 515 in any one of eyelets 520*a*, 520*b*, 520*c*, to 520*n* is approximately the same as the length of strap portion 505 between any two of separation points 515*a*, 515*b*, 515*c*, to 515*n*. Thus, very little slack is provided within each of eyelets 520*a*, 520*b*, 520*c*, to 520*n* and the overall size of each of eyelets 520*a*, 520*b*, 520*c*, to 520*n* is reduced in comparison with hammock strap 400, shown in FIG. 4, for example. Accordingly, the amount of material used to form hammock strap 500 is correspondingly reduced which, in turn, reduces the overall bulk and weight of hammock strap 500.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A hammock strap, comprising:

a first loop of flexible strap material terminating one end of the hammock strap, wherein the first loop is formed by stitching the one end of the hammock strap back onto itself;

a length of flexible strap material implemented as a single piece of flexible strap material which is separated into a first strap and a second strap at one or more separation points to form one or more eyelets between the first strap and the second strap, wherein between the one or more separation points, the first strap and the second strap are woven back together to form the single piece of flexible strap material; and wherein the hammock strap tapers from a first width at the first loop to approximately half of the first width between the first loop and the first of the one or more eyelets along the length of flexible strap material.

2. The hammock strap of claim 1, wherein the flexible strap material is webbing.

3. The hammock strap of claim 1, further comprising:

a second loop which terminates a second end of the hammock strap.

4. The hammock strap of claim 3, wherein the second loop which terminates the second end of the hammock strap has a width of approximately half of the first width of the first loop.

5. The hammock strap of claim 4, wherein the first strap is stitched to the second strap to form the second loop.

6. The hammock strap of claim 1, wherein the one or more eyelets comprises between 5 and 20 eyelets.

7. The hammock strap of claim 1, wherein any one eyelet is disposed between at least two separation points between the first strap and the second strap.

8. The hammock strap of claim 1, wherein a length of the second strap between any two separation points is longer than a length of the first strap between the two separation points.

9. The hammock strap of claim 1, wherein a length of the second strap between any two separation points is substantially the same as a length of the first strap between the two separation points.

10. The hammock strap of claim 1, wherein weaving the first strap into the second strap at one or more separation points to form the single piece of flexible strap material comprises interlocking fibers of the first strap with fibers of the second strap.

* * * * *